United States Patent [19]

Stojek

[11] Patent Number: 4,551,284

[45] Date of Patent: Nov. 5, 1985

[54] CARBURETOR WITH A SLIDABLE THROTTLE MEMBER CONTROLLING THE AIR INDUCTION PASSAGE

[75] Inventor: Dieter Stojek, Bergisch Gladbach, Fed. Rep. of Germany

[73] Assignee: Ford Motor Company, Dearborn, Mich.

[21] Appl. No.: 639,276

[22] Filed: Aug. 9, 1984

[30] Foreign Application Priority Data

Aug. 22, 1983 [DE] Fed. Rep. of Germany ..... 3330235

[51] Int. Cl.[4] ..... F02M 9/06

[52] U.S. Cl. ..... 261/44 B; 261/DIG. 56; 251/158; 251/326

[58] Field of Search ..... 261/44 B, DIG. 56, 44 C; 251/158, 326

[56] References Cited

U.S. PATENT DOCUMENTS

| | | | |
|---|---|---|---|
| 1,656,183 | 1/1928 | Enz | 251/158 |
| 1,793,148 | 2/1931 | Warlay | 261/44 B |
| 3,216,694 | 11/1965 | Perazone | 251/158 |
| 3,321,174 | 5/1967 | Schertler | 251/158 |
| 3,397,862 | 8/1968 | Batzer et al. | 251/158 |
| 3,768,773 | 10/1973 | Stephens | 251/158 |
| 3,822,058 | 7/1974 | Carter | 261/44 B |
| 3,907,250 | 9/1975 | Kane | 251/158 |
| 3,975,221 | 6/1976 | Englert et al. | 261/44 B |
| 4,071,221 | 1/1978 | Sciascio et al. | 251/158 |
| 4,221,747 | 9/1980 | Edmonston | 261/44 B |

FOREIGN PATENT DOCUMENTS

| | | | |
|---|---|---|---|
| 53-147131 | 12/1978 | Japan | 261/DIG. 56 |

*Primary Examiner*—Tim Miles

*Attorney, Agent, or Firm*—Clifford L. Sadler; Robert E. McCollum

[57] ABSTRACT

A carburetor has a throttle member in the form of a slide for controlling the air induction passage, the slide being displaceably guided in a sealed and sliding manner on planer edge areas of guide surfaces of a surface extending substantially at right angles to the induction passage, the slide being relieved from vertical downward pressures exerted on the guide surfaces by the manifold vacuum acting on the underside of the slide by an unloading mechanism controlled by the vacuum force, the unloading mechanism comprising lifting rails which are pivotally mounted for engagement with the slide and include rollers that may be raised or lowered by devices that are responsive to the change in vacuum below the slide as the slide moves closed or open to counteract the differential pressure force acting on the slide.

6 Claims, 4 Drawing Figures

FIG.3
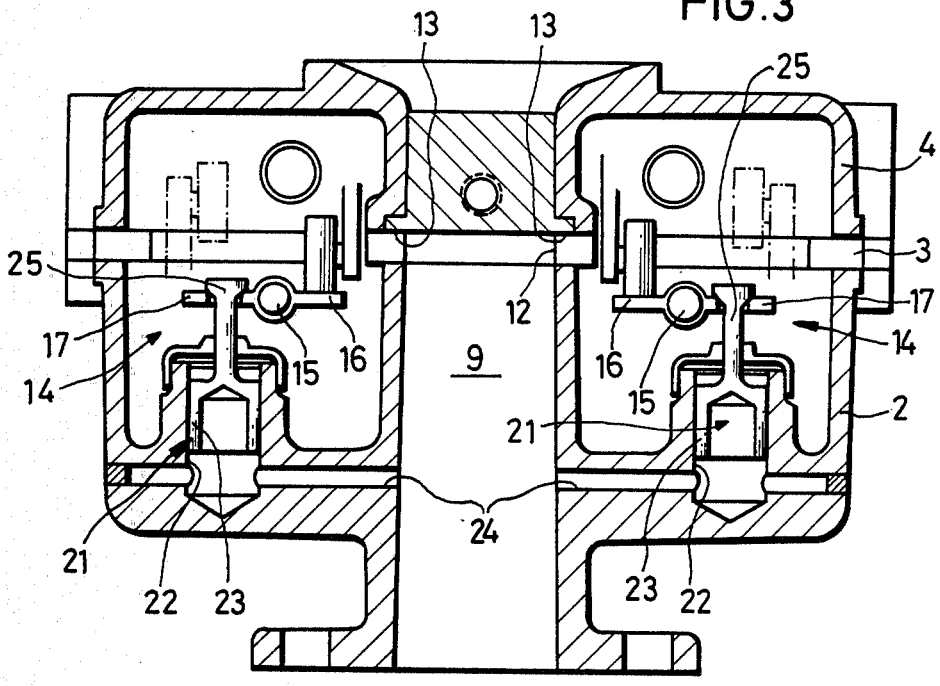
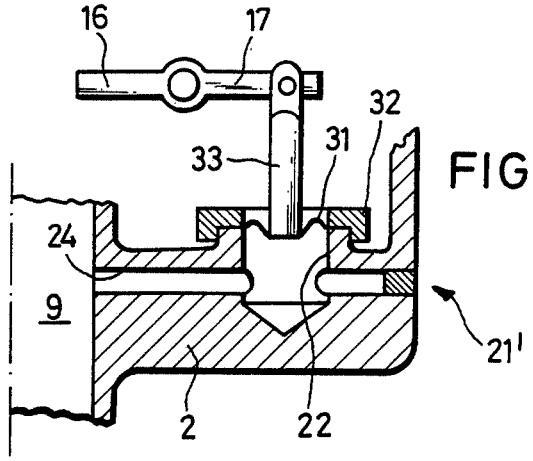
FIG.4

CARBURETOR WITH A SLIDABLE THROTTLE MEMBER CONTROLLING THE AIR INDUCTION PASSAGE

This invention relates to an improvement of the carburetor described in my patent application U.S. Ser. No. 526,833, filed Aug. 26, 1983, now U.S. Pat. No. 4,465,644, titled CARBURETOR WITH AN INDUCTION PASSAGE CONTROLLED BY A THROTTLE SLIDE.

The prior carburetor was provided with an unloading mechanism that relieved the throttle slide from the downwardly acting compression exerted by the manifold vacuum acting on the horizontal guide undersurfaces to ensure a uniformly easy and jerk-free horizontal setting of the slide.

An object of the present invention is to improve the unloading device for the above carburetor by disclosing various simpler structural solutions.

More particularly, the unloading mechanism of the invention comprises vertically movable lifting rails on which the throttle slide is supported, the rails being pivotally mounted for exerting an upward force on the throttle valve slide member essentially equal in value to the downwardly acting vacuum force acting on the underside of the throttle slide. The rails are pivotally mounted on fulcrum pins at the side of the slide guide surfaces and are formed with bell crank type lever arm portions that are engaged by pivotably articulated actuating devices, such as a piston or a diaphragm operated member, to be moved by the manifold vacuum to raise or lower the lifting rails, the slide being supported on the lifting rails by a roller assembly mounted on a transversely disposed bar fixed to the slide, a simpler constructional and assembly outlay thus being made possible.

The throttle slide may be moved in the throttle bore opening direction by a Bowden cable, servo motor or the like, against the force of tension springs, by way of a further roller assembly. The latter engages a second transversely arranged bar fixed to the slide and mounted on a transversely disposed yoke that is pivotable both about a horizntal shaft and also about a vertical axis, the latter mounting permitting tilting or cocking of the slide in the event of unequal tension spring forces applied to opposite sides of the slide.

In this latter connection, the actuating devices acted upon by the manifold vacuum may be constructed, for example, either as cylinder-piston units, or as chamber-diaphragm units.

Other objects, features and advantages of the invention will become more apparent upon reference to the succeeding detailed description thereof and to the drawings; wherein, FIG. 1 is a vertical cross-sectional view through a carburetor constructed according to the invention;

FIG. 3 is a cross-sectional view along the line III—III of FIG. 1; and,

FIG. 4 is an alternative embodiment of an actuating device shown in FIG. 3.

Figure 1:
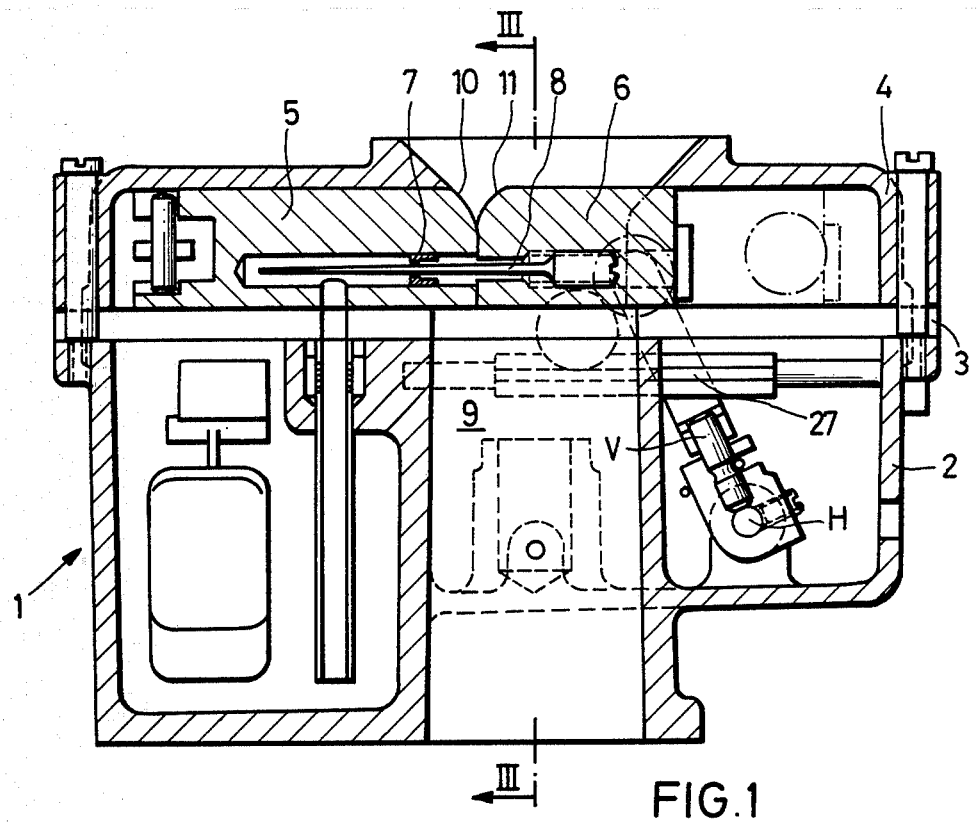

The carburetor 1 illustrated in the Figures comprises a main body 2, a central plate 3, and a hollow cover 4. Above the plate 3, in the cavity of cover 4, are disposed a fixed fuel jet block 5 and a horizontally movable throttle slide 6. A fuel jet orifice or nozzle 7 disposed in the jet block 5 cooperates with a fuel jet needle 8 which is secured to slide 6 in a known manner. In a setting movement of the slide 6, which can be effected as desired either mechanically in known manner or electronically by a servo motor or the like, not shown, the air and fuel inducted into the induction passage 9 of the carburetor will thereby be controlled.

The induction passage 9 of carburetor 1 has a rectangular cross-section, and the adjacent cooperating upper wall surfaces 10 and 11 of jet block 5 and slide 6 that face one another form a variable area, optimized-flow, Venturi-like passage between.

The precise cross-section of induction passage 9 is determined by an opening 12 (FIGS. 1 and 3) in central plate 3 between main body 2 and cover 4 of the carburetor and by the size of the horizontal gap between slide 6 and jet block 5. Slide 6 has planer edge areas 13 (FIG. 3) by which it is slidably and sealingly guided on the contiguous peripheral edge areas of central plate 3 that define opening 12. Although such a seal of a slide over its planer edge area that is normal to induction passage 9 ensures a good seal, the pressure differential between the upper and lower surfaces of slide 6, which varies as slide 6 is opened to a varying extent, lead to considerable pressure differences and large vertical loads on these sliding surfaces. This may result in an undesired large frictional resistence to movement, which can lead to jerky horizontal settings affecting the operation as slide 6 is actuated, and in particular in the part load operating range with the higher vacuums occurring below slide 6 in this range.

According to the invention, slide 6 is automatically relieved from these high vertical compression loads acting on the guide surfaces by way of an unloading device 14 controlled by the vacuum.

Figure 2:
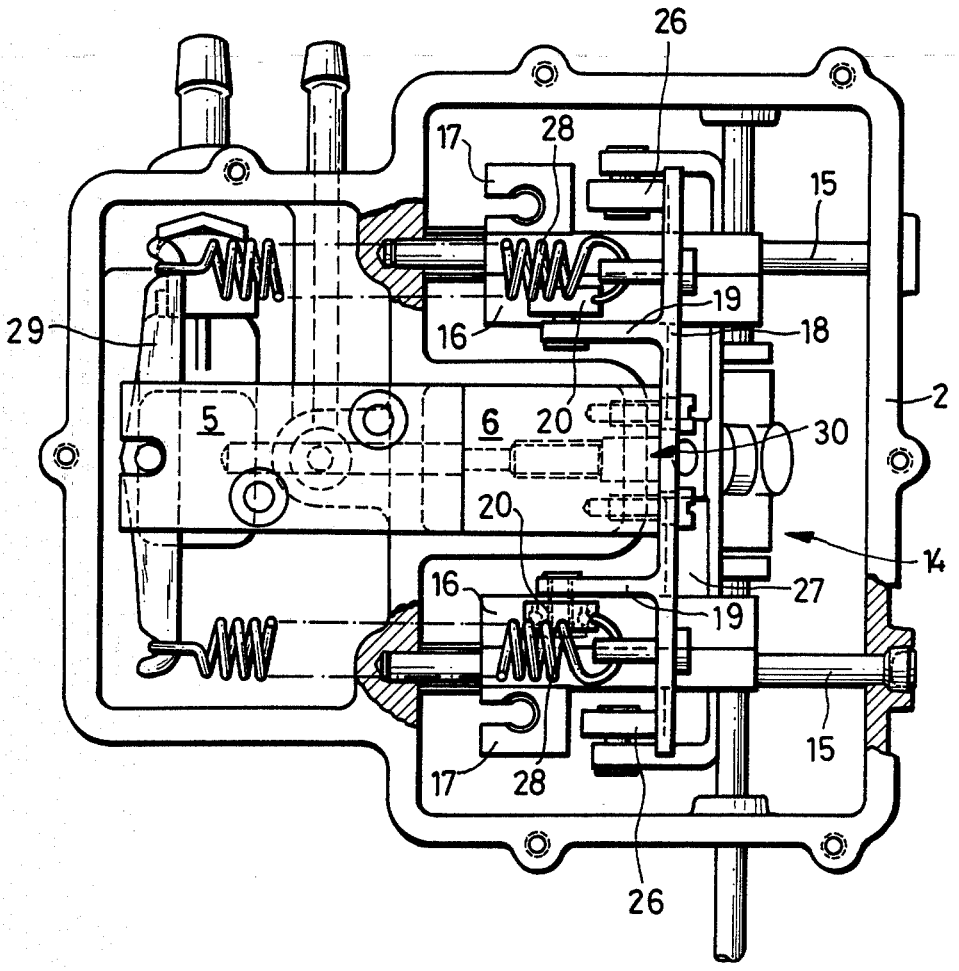
FIG. 2 is a plan view of the carburetor of FIG. 1, with the cover removed.

The design of unloading device 14 may be seen in particular in FIGS. 2 and 3. A pair of lifting rails 16 are rotatably mounted in bell crank fashion on pivot pins 15 mounted in the body 2 and are formed with lever arm projecting portions 17. Secured to slide 6 is a transversely extending bar 18 on which are rotatably supported on arms 19 ball-monted rollers 20 that support slide 6 on the lifting rails 16. A pair of vacuum actuated piston devices 21 engage each of the lever arm portions 17 of lifting rails 16 for exerting a force on the slide to counteract the effective downward pressure differential resulting from the application of the manifold vacuum to the slide.

In the embodiment shown in FIG. 3, actuating devices 21 include bores 22 provided in main body 2 and pistons 23 disposed therein, the bores 22 communicating with the manifold vacuum in induction passage 9 by way of passages 24. Pistons 23 are provided with rods 25 which project upwards for a pivotal connection to lever arms 17 of lifting rails 16.

FIGS. 1 and 2 show additional ball-mounted rollers 26 rotatably mounted on a transversly extending yoke-like member 27. Member 27 is pivotable both about a horizontal shaft H and also about a vertical shaft V (FIG. 1) at right angles to shaft H. The rollers engage opposite ends of the transversely extending bar 18, for moving the bar and slide 6. The transverse yoke 27 may be moved in a slide opening direction by a Bowden cable, servo motor or the like (not shown) that would be secured at 39 to slide 6, and would operate against the force of a pair of tension springs 28. The latter each are hooked to bar 18 at one end and at its other end to a yoke 29 pivoted on jet block 5.

In an alternative embodiment shown in FIG. 4, the vacuum actuated devices 21 may be in the form of chamber-diaphragm units instead of cylinder-piston unis. In this case, the upper end of bores 22, which communicate with the induction passage 9 by way of passages 24, are closed by an annular flexible diaphragm 31 that is secured to main body 2 by a fastening ring 32. The diaphragm is connected to a rod 33 which engages lever arm portion 17 of a corresponding lifting rail 16 in a pivoting manner.

Other suitable arrangements are, of course, possible in the design of the articulated connection between rods 25 or 33, respectively, of the actuating devices 21 or 21', respectively, acted upon by the manifold vacuum.

In operation, briefly, in the closed slide position shown in the Figures, the high engine manifold vacuum in induction passage 9 during engine idle speed operation is communicated to pistons 23 in FIG. 3. The resultant pulldown of rod 25 attempts to pivot lifting rail 16 upwardly to raise roller 20 and slide 6. The resultant upward vertical force exerted on slide 6 counteracts or essentially balances the high downward pressure exerted on the upper surface of slide 6 due to the large pressure differential across the slide between atmospheric and subatmospheric or manifold vacuum levels. The slide, therefore, can be moved horizontally with only a light effort.

Movement, therefore, of the Bowden wire cable, not shown, to the right as seen in FIG. 1, now will pivot yoke arm 27 about shaft H and move rollers 26 rightwardly (FIG. 2) to move bar 18 and slide 6 in the same opening direction against the tension of springs 28. In the event the force of one of the springs is slightly different than that of the other, bar 18 may pivot about the vertical axis V (FIG. 1) without transmitting a cocking or binding action to slide 6. As the slide moves rightwardly, the manifold vacuum level decreases proportionately, as does the pressure differential on slide 6 and the force applied to piston 23. The forces vary, therefore, in proportion to one another as the slide moves in one direction or the other, to always maintain a balance between the pressure differential on the slide due to the manifold vacuum acting directly on the underside thereof, and the counteracting force exerted thereon by the lifting rail rollers 20.

While the invention has been shown and described in its preferred embodiments, it will be clear to those skilled in the arts to which it pertains that many changes and modifications may be made thereto without departing from the scope of the invention.

I claim:

1. In a carburetor having a slide type throttle member controlling flow through the induction passage, said slide being sealingly and slidably movable laterally on a planar surface extending substantially normal to the induction passage, the slide sealing surfaces being subjected to a vertical downward loading resulting from the pressure differential between a near atmospheric pressure acting on top of the slide and engine intake manifold vacuum acting beneath the slide, and an unloading mechanism responsive to changes in the vacuum below the slide for opposing the vertical downward loading exerted on the guide surface to enable lateral movement of the slide with minimum effort, the improvement comprising, lifting rail means tiltably mounted for rotation about an axis parallel to the slide surface, roller means rotatably secured to the slide and engaged by one side portion of the lifting rail projecting laterally to one side of the axis for exerting a vertical upward force on the slide upon predetermined pivotal movements of the rail, a manifold vacuum actuated device secured to another portion of the lifting rail projecting laterally to the opposite side of the axis for tilting the rail with a force varying in response to the changes in manifold vacuum, and a further lever arrangement operably connected to the slide and pivotally mounted for an arcuate movement essentially horizontally for moving the slide in opening and closing directions.

2. In a carburetor as in claim 1, the rail means including a pair of rails located to opposite lateral sides of the slide, and a transversely extending bar secured to the slide and rotatably supporting a pair of rollers thereon, each roller engaging one of the lifting rails, the rollers being horizontally movable on the rails upon movement of the slide, spring means biasing the slide to a closed position, and controllable means for moving the slide in an opening direction.

3. In a carburetor as in claim 2, the further lever arrangement including a second transversely extending yoke-like bar having rollers rotatably mounted on opposite ends thereof engageable with the first mentioned bar, pivotal movement of the second bar moving the first mentioned bar and slide in the same direction.

4. In a carburetor as in claim 3, the further means also being rotatably mounted for rotation about a vertical axis centrally located adjacent the longitudinal axis of the slide, the spring means including a pair of springs each located to opposite lateral sides of the slide for engagement with a corresponding lateral portion of the first mentioned bar, the tilting mounting of the further means permitting a tilting movement of the second bar about the vertical axis in the event of an unequal application of force on the bar by the pair of springs to minimize cocking of the slide laterally about its longitudinal axis.

5. In a carburetor as in claim 4, the manifold actuated devices comprising a piston and piston rod assembly operable by the changes in manifold vacuum connected thereto for tilting the lifting rail and exerting an upward force on the slide surface that varies in proportion to the change in vacuum as the slide moves open and closed.

6. In a carburetor as in claim 4, the manifold actuated devices comprising a flexible annular diaphragm and rod assembly operable by the changes in manifold vacuum connected thereto for tilting the lifting rail and exerting an upward force on the slide surface that varies in proportion to the change in vacuum as the slide moves open and closed.

* * * * *